US008414255B2

(12) United States Patent
Ireland et al.

(10) Patent No.: US 8,414,255 B2
(45) Date of Patent: Apr. 9, 2013

(54) IMPINGEMENT COOLING ARRANGEMENT FOR A GAS TURBINE ENGINE

(75) Inventors: Peter T Ireland, Derby (GB); Gareth Newcombe, Wakefield (GB); Andrew J Mullender, Nottingham (GB)

(73) Assignee: Rolls-Royce PLC, London (GB)

( * ) Notice: Subject to any disclaimer, the term of this patent is extended or adjusted under 35 U.S.C. 154(b) by 605 days.

(21) Appl. No.: 12/708,207

(22) Filed: Feb. 18, 2010

(65) Prior Publication Data

US 2010/0232947 A1 Sep. 16, 2010

(30) Foreign Application Priority Data

Mar. 11, 2009 (GB) ..... 0904118.7

(51) Int. Cl.
*F01D 25/14* (2006.01)
*F01D 11/14* (2006.01)

(52) U.S. Cl.
USPC ..... 415/178; 415/116

(58) Field of Classification Search ..... 415/178, 415/177, 134, 173.1, 173.7, 174.2, 174.3, 415/115, 116
See application file for complete search history.

(56) References Cited

U.S. PATENT DOCUMENTS

| | | | | |
|---|---|---|---|---|
| 3,800,864 | A * | 4/1974 | Hauser et al. | 165/47 |
| 4,023,919 | A * | 5/1977 | Patterson | 415/134 |
| 4,573,865 | A * | 3/1986 | Hsia et al. | 415/115 |
| 5,100,291 | A * | 3/1992 | Glover | 415/115 |

(Continued)

FOREIGN PATENT DOCUMENTS

| | | |
|---|---|---|
| EP | 0 709 550 A1 | 5/1996 |
| EP | 1 930 550 A2 | 6/2008 |
| EP | 1 990 507 A1 | 11/2008 |
| GB | 2 104 965 A | 3/1983 |
| JP | 11-257003 | 9/1999 |

OTHER PUBLICATIONS

British Search Report issued in British Patent Application No. GB0904118.7, on Jun. 29, 2009.

*Primary Examiner* — Nathaniel Wiehe
*Assistant Examiner* — Aaron Jagoda
(74) *Attorney, Agent, or Firm* — Oliff & Berridge, PLC

(57) ABSTRACT

There is disclosed an impingement cooling arrangement for a gas turbine engine (6), and an engine provided with such an arrangement. The cooling arrangement comprises at least part of a casing (21) configured to define a flowpath for the passage of hot gases through the engine, and a manifold (22) configured to direct cooling air against an outer surface (23) of the casing for impingement cooling thereof. The arrangement is characterized by said manifold (22) being configured to direct a primary flow of cooling air (65) against a first area (64) of the casing outer surface (23) for impingement cooling of said first area, and to recirculate (66) at least a portion of said primary flow of cooling air after impingement against said first area (64) and to direct at least a portion of the recirculated flow against a second area (67) of the casing outer surface (23) for impingement cooling of said second area (67). In a preferred arrangement, the manifold (22) is spaced from said casing (21) so as to define a space (41) between the manifold and the outer surface (23) of the casing, and the manifold (22) further comprises a baffle (46) extending at least partially across said space, substantially towards said casing (21), so as to at least partially divide said space (41) into a first region (58) adjacent said first area (64), and a second region (59) adjacent said second area (67).

12 Claims, 3 Drawing Sheets

U.S. PATENT DOCUMENTS 5,351,732 A * 10/1994 Mills et al. ..... 415/175
5,407,320 A * 4/1995 Hutchinson ..... 415/116
6,625,989 B2 * 9/2003 Boeck ..... 60/782
2003/0131980 A1 7/2003 DeMarche et al.

* cited by examiner

IMPINGEMENT COOLING ARRANGEMENT FOR A GAS TURBINE ENGINE

The present invention relates to an impingement cooling arrangement for a gas turbine engine, and to a gas turbine engine incorporating such an arrangement.

The importance of providing appropriate systems to cool turbine casings in gas turbine engines is widely known. As will be appreciated to those of skill in the art, such turbines operate at extremely high temperatures and it is therefore important to cool the surrounding turbine casing in order to maintain the structural integrity of the casing. However, it is also known to use such cooling systems in order to control the thermal growth of the turbine casing, thereby controlling the clearance between the tips of the turbine blades and the adjacent casing during transient operation of the engine. Minimising blade tip clearance has a significant effect on the efficiency of the engine, and in particular on its specific fuel consumption. Several methods of cooling such structures have been proposed previously, most of which involve the use of a flow of cooling air.

One widely used method of cooling turbine casings is to use an impingement cooling arrangement. In such an arrangement, cooling air is generally directed in a number of jets so as to impinge upon the surface of a structure needing to be cooled. In an arrangement specifically configured to cool a turbine casing, it has been proposed previously to direct the cooling air jets so as to impinge against the outer surface of the casing, opposite to the inner surface of the casing which defines the flow path for the hot gases flowing through the turbine. In conventional gas turbine engines incorporating such an impingement cooling arrangement, the cooling air is generally obtained at high pressure from the upstream compressor of the engine. However, in the case of turbofan engines, such as those conventionally used in the aero industry, it has also been proposed to draw the cooling air from the bypass flow of air exiting the front fan of the engine and flowing along the generally annular bypass duct surrounding the core components of the engine.

FIG. 1 illustrates a generally conventional turbine casing in perspective view. The casing 1 may be made up of a series of circumferentially adjacent casing segments, but in its completed form has a generally ring-shaped configuration having an inner surface 2 which defines a flow path for the flow of hot gases passing through the turbine, and an opposed outer surface 3. A manifold 4 is provided around the outside of the casing 1, the manifold 4 being fluidly connected to a supply of cooling air, for example obtained from the upstream compressor section of the engine, or from the bypass duct. As illustrated most clearly in FIG. 2 which represents a cross-sectional view taken through a region of the casing 1 and the adjacent manifold 4, the manifold 4 is provided with an array of small outlet apertures, each of which is arranged to direct a respective flow of cooling air against the inner surface 3 of the casing 1 in the form of a jet of air, as indicated schematically by the arrows 5.

As will be appreciated, diverting even a relatively small proportion of the bypass airflow from the bypass duct to the cooling manifold 4 for impingement cooling purposes has a negative effect on the operating efficiency of the engine, and in particular the contribution to overall thrust arising from the forward fan. It is therefore desirable to maximise the cooling effect contributed by the cooling air flow so that the flow rate of air required for impingement cooling purposes can be minimised.

It is therefore an object of the present invention to provide an improved impingement cooling arrangement for a gas turbine engine.

According to the present invention, there is provided an impingement cooling arrangement for a gas turbine engine, the arrangement comprising at least part of a casing configured to define a flow path for the passage of hot gases through the engine, and a manifold configured to direct cooling air against an outer surface of the casing for impingement cooling thereof, wherein said manifold is configured to direct a primary flow of cooling air against a first area of the casing outer surface for impingement cooling of said first area, and to recirculate at least a portion of said primary flow of cooling air after impingement against said first area and to direct at least a portion of the recirculated flow against a second area of the casing outer surface for impingement cooling of said second area.

As will therefore be appreciated, the present invention effectively provides a cascade or series impingement cooling arrangement in which the impingement cooling air is recirculated so as to be used more than once for cooling purposes. As indicated above, in its broadest sense the invention involves recirculating the impingement air used to cool the first area of the casing only once, for redirection against a second area of the casing outer surface. However, it is envisaged that in some embodiments, the arrangement of the present invention could be configured to subsequently recirculate the impingement cooling air directed against the second area of the casing for subsequent impingement cooling of a third area of the casing in a similar manner. The cooling air could optionally be recirculated even more times, the arrangement thus involving the cascading of the impingement cooling air any convenient number of times.

In preferred embodiments of the invention, said second area of the casing outer surface is located downstream of said first area relative to the flow direction of hot gases through the engine.

The manifold may be spaced from said casing so as to define a space between the manifold and the outer surface of the casing, the manifold further comprising a baffle extending at least partially across said space, substantially towards said casing, so as to at least partially divide said space into a first region adjacent said first area, and a second region adjacent said second area.

In such an arrangement, the baffle is preferably configured so as to substantially seal against the outer surface of said casing, between said first and second areas.

Said baffle may comprise a substantially flexible seal configured to bear against the outer surface of said casing in a substantially sealing manner whilst permitting relative movement between the manifold and the casing. The flexible seal is most preferably arranged so as to make an acute angle with the outer surface the casing.

In one proposed embodiment of the present invention, said manifold is configured so as to comprise a plenum chamber having at least one air inlet in fluid communication with said first region of the space between the manifold and the casing to admit said recirculated flow into the plenum chamber, and at least one fluid outlet in fluid communication with said second area and configured to direct said recirculated flow of cooling air from the plenum chamber against said second area in a jet.

In such an arrangement, said plenum chamber preferably has a plurality of said fluid outlets arranged to direct said recirculated flow of cooling air from the plenum chamber against said second area in a plurality of jets.

In another proposed embodiment, at least one flow aperture is provided through the baffle so as to fluidly interconnect the first and second regions of said space and being configured to direct said recirculated flow of cooling air against said second area in a jet. Preferably, a plurality of said flow apertures are provided and are arranged to direct said recirculated flow of cooling air against said second area in a plurality of jets.

Said manifold preferably comprises a plurality of fluid outlets arranged to direct said primary flow of cooling air against said first area in a plurality of respective jets.

According to another aspect of the present invention, there is provided a gas turbine engine provided with an impingement cooling arrangement of the type indicated above.

Preferably, the engine takes the form of a ducted fan (or so-called "turbofan") engine having a bypass duct defining a passage for the flow of bypass air exiting the fan, wherein the impingement cooling arrangement is configured to draw said cooling air from the bypass air flowing along said bypass duct.

So that the invention may be more readily understood, and so that further features thereof my be appreciated, embodiments of the invention will now be described by way of example with reference to the accompanying drawings in which.

Figure 3:
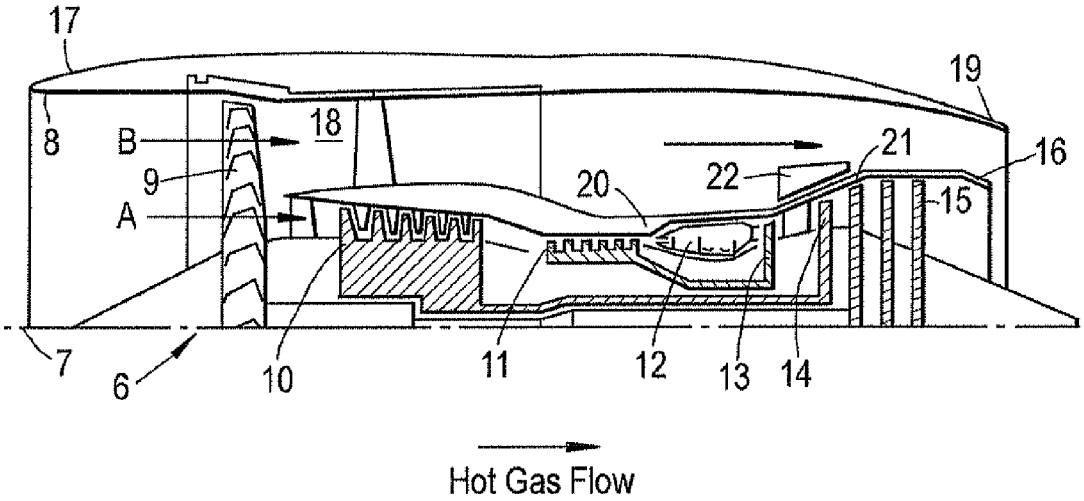
FIG. 3 is a transverse cross-sectional view through part of a gas turbine engine provided with an impingement cooling arrangement.

Referring now in more detail to FIG. 3, there is shown a ducted fan gas turbine engine 6 having a principle and rotational axis 7. The engine comprises, in axial flow series; an air intake 8, a propulsive fan 9, an intermediate pressure compressor 10, a high pressure compressor 11, combustion equipment 12, a high pressure turbine 13, an intermediate pressure turbine 14, a low pressure turbine 15 and a core exhaust nozzle 16. A nacelle 17 generally surrounds the engine 6 and defines the intake 8, a bypass duct 18 and an exhaust nozzle 19. A casing or shroud 20 generally surrounds the core components of the engine and includes a turbine casing 21 which surrounds the three turbines, and which defines the outer extent of the flowpath for hot gases through the turbines. Arranged generally around the turbine casing 21 is a substantially annular manifold 22 which will be described in more detail hereinafter.

The gas turbine engine 6 operates in a generally conventional manner such that air enters the intake 8 and is accelerated by the fan 9. Two air flows are thus produced; a core air flow A which passes into the intermediate pressure compressor 10, and a bypass air flow B which passes through the bypass duct 18 to provide propulsive thrust. The intermediate compressor 10 compresses the core air flow A and delivers the resulting compressed air to the high pressure compressor 11 where further compression occurs.

The resulting compressed air exhausted from the high pressure compressor 11 is directed into the combustion equipment 12 where it is mixed with fuel, and the resulting mixture ignited. The resultant hot gases then expand through, and thereby drive, the high, intermediate and low pressure turbines 13, 14, 15, before being exhausted through the core exhaust nozzle 16 to provide additional thrust. The high, intermediate, and low pressure turbines 13, 14, 15 respectively drive the high and intermediate compressors 10, 11 and the fan 9 via respective interconnecting shafts (not shown).

Figure 4:
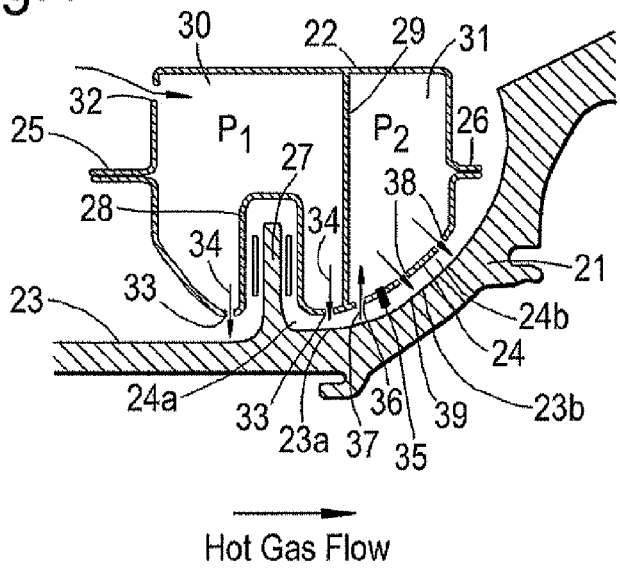
FIG. 4 is a radial cross-sectional view taken through part of the engine's turbine casing, showing an adjacent air impingement manifold.

As will be appreciated, following compression of the core air flow A and subsequent combustion of the compressed air, the gases flowing through the turbines 13, 14, 15 are at very high temperature. It is therefore important to cool the turbine casing 21 in order to maintain its structural integrity and also to control the thermal growth of the casing, thereby controlling the clearance between the tips of the turbine rotor blades and the turbine casing 21. The annular manifold 22 provided around the turbine casing 21 is provided for this purpose and forms part of an air impingement cooling arrangement as will be described in more detail below. It should be appreciated, however, that the manifold 22 illustrated in FIGS. 3 and 4 is provided around part of the turbine casing 21 which encloses the intermediate pressure turbine 14. Nevertheless, it should be appreciated that similar arrangements can be used to cool the turbine casing in regions where it encloses the low and high pressure turbines 13, 14.

FIG. 4 illustrates, in simplified schematic form, the configuration of an example of a manifold 22 forming part of an air impingement cooling arrangement of the present invention. As will be noted, the manifold 22 is provided in spaced relation to the generally adjacent outer surface 23 of the turbine casing 21. In this manner, a narrow annular space 24 is defined between the manifold 22 and the outer surface 23 of the turbine casing 21. As also illustrated in FIG. 4, the manifold 22 may be provided with appropriate front and rear mounting flanges 25, 26 which are configured to mount the manifold securely in position within the engine, around the turbine casing 21. The particular manifold 22, illustrated in FIG. 4 is mounted around the turbine casing 21 at a longitudinal position along the casing which coincides with the position of a radially outwardly extending mounting flange 27 provided on the shroud. The manifold 22 is thus formed so as to have a corresponding re-entrant recess 28 shaped to fit around the mounting flange 27 and the associated structure of the engine to which the flange is connected.

The manifold 22 is divided internally, by a substantially radially extending inner wall 29, into two fluidly-distinct chambers 30, 31. The upstream chamber 30 (i.e. upstream with respect to the direction of hot gases flowing through the engine) serves as a primary plenum chamber, and the downstream chamber 31 serves as a secondary plenum chamber in a manner which will be described in more detail below.

The forwardmost region of the manifold 22 is provided with an array of air inlet apertures 32 arranged around the annulus of the manifold. As will therefore be appreciated, each air inlet aperture 32 is presented to the oncoming bypass flow B flowing through the bypass duct 18, and the air inlet apertures 32 thus serve to admit a flow of air, drawn from the bypass flow B, into the primary plenum chamber 30. This air is used for impingement cooling of the turbine casing 21.

In order to allow the flow of cooling air out of the primary plenum chamber 30, the chamber is provided with an array of air outlet apertures 33, each of which is formed through the region of the manifold located closest to the turbine casing 21. The air outlet apertures 33 may, for example, be arranged in a number of rows, each row comprising a plurality of apertures spaced apart around the inner extent of the annular manifold. The outlet apertures 33 are configured so that each directs a respective jet of cooling air in a generally normal direction against the adjacent outer surface 23 of the turbine casing 21, as illustrated schematically by arrows 34 in FIG. 4. These jets of cooling air 34 thus impinge on a first area 23*a* of the outer surface 23, located generally adjacent the primary plenum chamber 31, thereby cooling the casing 21 in this region in a generally conventional manner.

However, as will now be explained in further detail, the cooling arrangement of the present invention is configured so as to recirculate the primary flow of cooling air directed as jets 34 through the air outlets 33 of the primary plenum chamber 30 for subsequent redirection against a downstream area 23*b* of the turbine casing outer surface 23 for further impingement cooling. In this regard, it is to be noted that the manifold 22 is provided, in a position slightly downstream from the primary plenum chamber 30, with an annular baffle 35 which extends radially inwardly from the manifold, in the region of the secondary plenum chamber 31. The baffle 35 extends at least partially across the space 24 defined between the inner extent of the manifold 22 and the outer surface 23 of the turbine casing 21. In this manner, the baffle 35 effectively serves to divide the space into a first region 24*a* generally adjacent the primary plenum chamber 30 and the first area 23*a* of the turbine casing 21 which is cooled by the air flowing out of the primary plenum chamber 30 and a second, downstream, region 24*b* located generally adjacent the secondary plenum chamber 31. The second region 24*b* of the space, on the downstream side of the baffle 35 can thus be considered to lie generally adjacent a second area 23*b* of the outer surface 23 of the turbine casing 21.

In preferred embodiments of the present invention, the baffle 35 is provided with a generally annular seal at its innermost edge, the seal being arranged to bear against the outer surface 23 of the turbine casing 21 in a sealing manner, thereby preventing significant flow of air from the first region 24*a* to the second region 24*b* of the space defined between the manifold 22 and the turbine casing 21. This seal is preferably flexible in order to accommodate the thermal expansion and contraction of the turbine casing 21.

Turning now to consider in more detail the particular features of the secondary plenum chamber 31, it is to be noted that the secondary plenum chamber 31 is provided with a plurality of air inlet apertures 36 which are preferably arranged in a ring around the manifold 22 on the upstream side of the baffle 35. The air inlet apertures 36 are thus provided in fluid communication with the first region 24*a* of the space between the manifold 22 and the casing 21. The air inlet apertures 36 thus serve to admit a recirculated flow of cooling air deflected from the outer surface 23*a* of the turbine casing following impingement cooling via the primary jet 34. The flow of this recirculated cooling air into the secondary plenum chamber 31 is indicated schematically by arrow 37 in FIG. 4.

On the downstream side of the baffle 35, the plenum chamber 31 is provided with a plurality of outlet apertures 38, each of which is configured so as to be directed towards the second area 23*b* of the outer surface of the turbine casing, thereby permitting the flow of recirculated cooling air from the secondary plenum chamber 31 in a series of cooling air jets indicated generally by arrows 39 which impinge on the second area 23*b* of the outer surface 23, thereby cooling that region of the inner surface via a second stage of impingement cooling.

As will therefore be appreciated, the air impingement arrangement of the present invention effectively provides for cascading or series air impingement cooling of the turbine casing 21. In the particular arrangement illustrated, the cooling air is recirculated so as to be used more than once for cooling purposes. The particular arrangement illustrated recycles the primary cooling air once for a single subsequent stage of impingement cooling. However, it should be appreciated that by the provision of further downstream plenum chambers and corresponding baffles, the arrangement of FIG. 4 could quite easily be extended so as to provide more recycling stages and hence further cascading stages of air impingement cooling.

Figure 1:
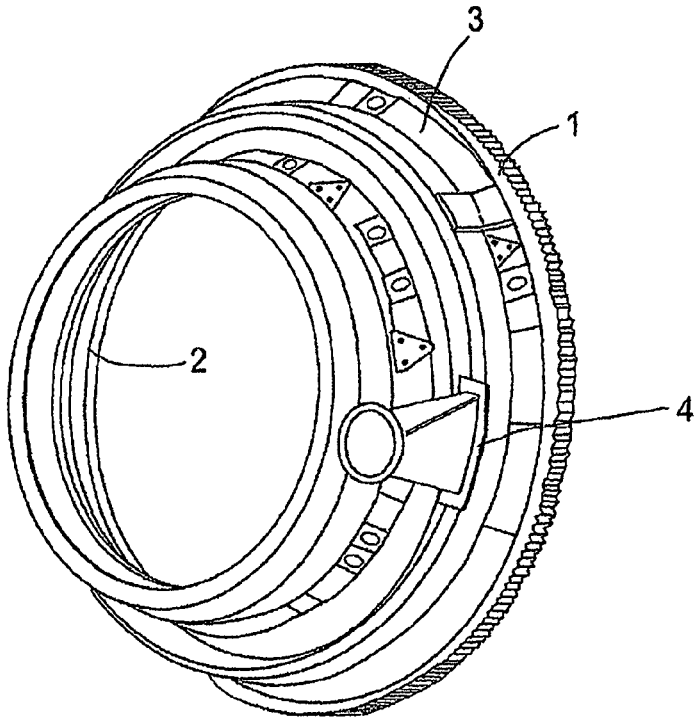
Fig.1 Prior Art
FIG. 1 is a perspective view showing a generally conventional turbine casing with an associated impingement cooling arrangement.
Figure 2:
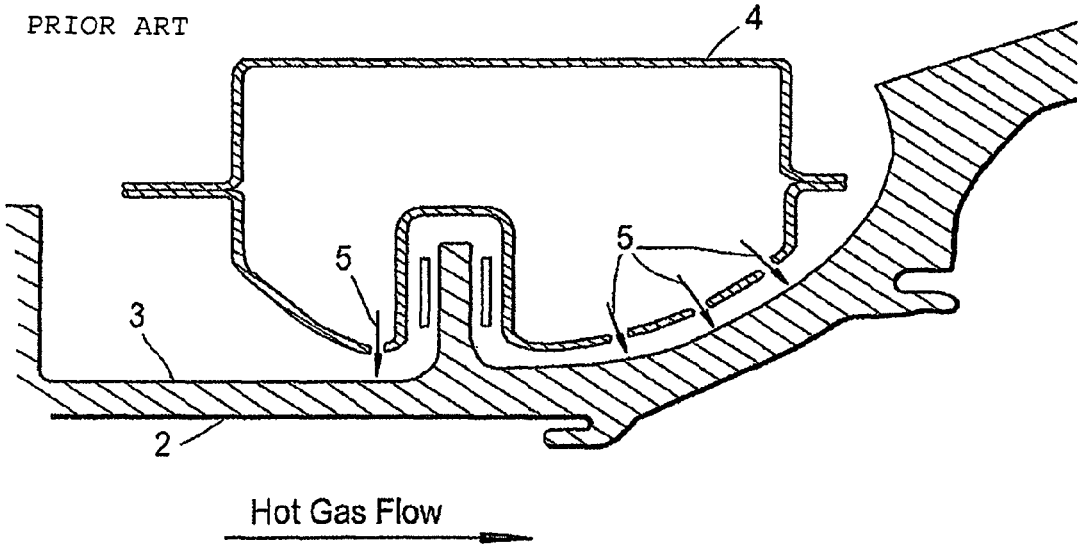
Fig.2 PRIOR ART
FIG. 2 is a radial cross-section taken through the casing arrangement illustrated in FIG. 1, showing a prior art arrangement of air impingement cooling jets.

As will therefore be appreciated, the air impingement cooling arrangement of the present invention, as described above, represents a significant improvement over previously proposed non-cascading arrangements. The arrangement of the present invention effectively improves cooling by using the available pressure margin between the bypass flow B in the bypass duct 18 (typically approximately 7 psi for a large civilian aero engine operating at cruise conditions) and the target cooling zone in such a way that the cooling air flow repeatedly impinges on the turbine casing. This strategy of cascading impingement offers significantly improved cooling because for a uniform array of jets, the mass-flow of cooling air flowing through the jets is increased in proportion to the number of consecutive cascaded impingement systems (i.e. the number of times the cascading air is recycled and redirected against the turbine casing for subsequent cooling). The heat transfer coefficient of each cooling jet of air increases as the jet flow rate increases. In particular, the heat transfer coefficient increases in proportion to the mass-flow rate raised to an exponent of approximately 0.75. In terms of round numbers this means that, in the absence of any additional pressure constraint, a triple cascade system in accordance with the present invention could be used to more than double the overall heat transfer coefficient of the arrangement compared to prior art arrangements such as that shown in FIG. 2.

Figure 5:
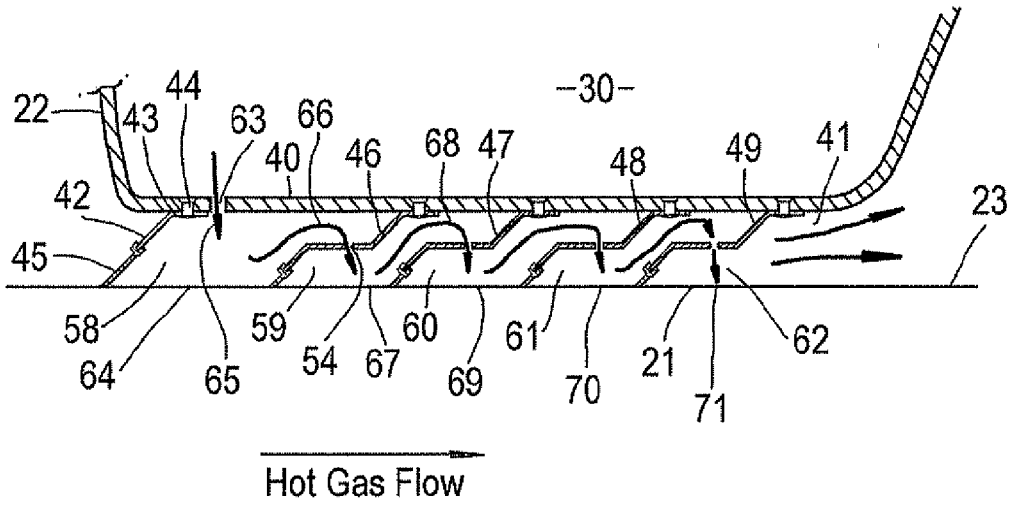
FIG. 5 is a schematic cross-sectional illustration showing an alternative form of air impingement manifold arrangement provided adjacent a section of turbine casing.

Turning now to consider FIG. 5, there is illustrated an alternative arrangement in accordance with the present invention which operates to recycle impingement cooling air four times and thus is effective to direct cooling air in the form of impingement jets against the outer surface 23 of the turbine casing 21 in five distinct stages. As will be noted, the arrangement illustrated in FIG. 5 is significantly longer in an axial direction relative to the rotational axis of the engine than the arrangement described above and illustrated in FIG. 4. This alternative arrangement has thus been found to lend itself particularly well to application in impingement cooling longer sections of casings such as the turbine casing surrounding a typical low pressure turbine which comprises a large number of turbine stages and hence has significant axial length.

In the arrangement illustrated in FIG. 5, the manifold 22 is again configured so as to have a generally annular form extending around the turbine casing 21, and comprises a radially inwardly directed base plate 40 which is spaced radially outwardly from the turbine casing 21 so as to define a space 41 between the manifold 22 and the outer surface 23 of the turbine casing 21.

In the arrangement of FIG. 5, the manifold 22 again comprises a series of appropriately located air inlet apertures in order to admit a flow of cooling air drawn from the bypass flow B of the gas turbine engine, into a central chamber 30 defined within the manifold 22.

In a forward, generally upstream region of the manifold 22 there is provided a primary seal 42 which extends generally forwardly, into the flow of hot gas through the turbine, and radially inwardly towards the turbine casing 21. As illustrated in FIG. 5, the primary seal 35 preferably comprises a metal ring having a generally axially directed mounting flange 43 for secure attachment of the seal 42 to the base plate 40 of the manifold 22, for example by a fixing rivet 44 or alternatively by a weld. Extending radially inwardly from the innermost edge of the primary seal 42 is a flexible sealing member 45 which is arranged to engage and bear against the outer surface 23 of the turbine casing 21 in a sealing manner. The flexible nature of the sealing member 45 ensures that an adequate fluid seal is provided against the outer surface 23 of the turbine casing 21 during thermal expansion and contraction of the casing.

Figure 6:
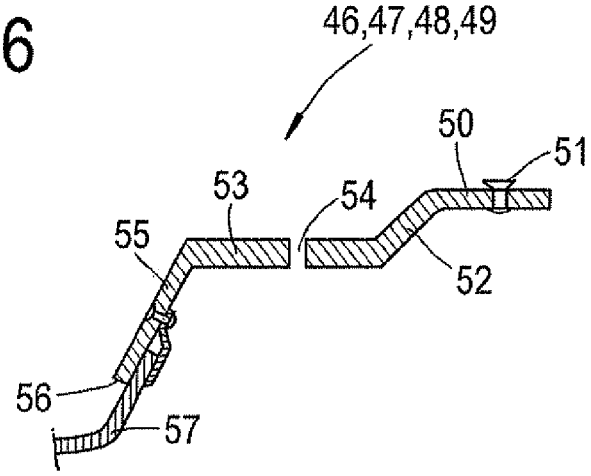
FIG. 6 is an enlarged view showing further details of a baffle plate forming part of the arrangement illustrated in FIG. 5.

Located downstream of the primary seal 42, there are provided a series of axially spaced apart baffles 46, 47, 48, 49, each of which has generally identical form as illustrated in further detail in FIG. 6. In particular, it is to be noted that each of the baffles is generally annular in form and has a radially outermost, generally axially extending mounting flange 50 which is substantially identical in from to the mounting flange 43 of the primary seal 42. The mounting flanges 50 of each baffle thus serve to engage against the innermost surface of the manifold base plate 40 and are secured in position against the base plate by a fixing rivet 51, or alternatively by a weld.

From the mounting flange 50 secured to the base plate 40 of the manifold 22, each baffle 46, 47, 48, 49 extends generally forwardly and radially inwardly towards the turbine casing 21. In particular, it will be noted that each baffle has a first inclined section 52 which is directed generally forwardly and radially inwardly towards the turbine casing 21. From the forwardmost region of the first inclined section 52, each baffle then comprises a forwardly extending section 53 which in cross-section lies generally parallel to the rotational axis of the engine. This section of the baffle is provided with a plurality of flow apertures 54 provided through it, the flow apertures being arranged in a convenient array extending around the annulus of the section 53. At the forwardmost end of the section 53, the baffle comprises a second inclined region 55 which extends generally forwardly and radially inwardly towards the turbine casing 21. At the forwardmost, and radially innermost edge 56, each baffle is provided with a forwardly and radially inwardly extending flexible seal 57 which may conveniently take a form substantially identical to the flexible sealing member 45 provided on the primary seal 42. In particular, the flexible seal 57 is secured to the forwardmost part of the second inclined region 55. As will be appreciated, the flexible nature of the seal 57 ensures that the seal will bear against the outer surface 23 of the turbine casing 21 in a sealing manner whilst accommodating thermal expansion and contraction of the turbine casing during operation of the engine. It is envisaged that the flexible seals 57, and indeed the flexible sealing member 45 provided on a primary seal 42, can take any convenient form depending upon the operating regime of the turbine whose casing 21 is to be cooled. For example, when used to cool high temperature casings, it is envisaged that the seals 57 will be metallic and may, in particular, be formed from a flexible sheet of stainless steel or nickel alloy. Alternatively, however, the seals may take the form of brush seals made from high temperature wire such as HAYNES 25 or a Nimonic alloy. As will be appreciated, the choice of seal material depends largely on the specific operating cycle of the turbine.

Referring now to consider in more detail the general arrangement illustrated in FIG. 5, it will be noted that each baffle 46, 47, 48, 49 effectively serves to divide the space between the manifold and the outer surface 23 of the turbine casing 21 into distinct regions. For example, on the upstream side of the first baffle 46, there is defined a first region 58, and on the downstream side of the first baffle 46 there is defined a second region 59. The second region 59 is in turn separated from a third region 60 which lies on the downstream side of the second baffle 47. Similarly, a fourth region 61 is defined on the downstream side of the third baffle 48, and a fifth region 62 is defined on the downstream side of the fourth baffle 49.

A series of fluid outlet apertures 63 are provided through the base plate 40 of the manifold 22 at a position immediately downstream of the primary seal 42. The fluid outlet apertures 63 thus provide fluid communication between the internal chamber 30 of the manifold 22 and the first region 58 of the space between the manifold and the turbine casing 21. During operation of the air impingement arrangement, the cooling air admitted into the internal chamber 30 from the bypass flow B is thus directed as a series of cooling jets through the fluid outlet apertures 23 so as to impinge against a first area 64 of the outer surface 23 of the turbine casing 21, as indicated generally by arrow 65. These air jets thus serve to cool the outer surface 23 via impingement, and the flow of air is deflected by the outer surface 23. Because the first region 58 of the space between the manifold and turbine casing is effectively sealed by the primary seal 42 and the flexible seal 57 of the first baffle 46, this cooling air has nowhere to escape after impingement on the first area 64 except through the flow apertures 54 provided through the first baffle 46. The cooling air is thus recirculated, as indicated generally by arrow 66 and directed through the flow apertures 54 as a series of secondary cooling jets which impinge on a second area 67 of the outer surface 23, the second area being defined between the seal of the first baffle 46 and the seal of the second downstream baffle 47. From here, the cooling air is again deflected by the outer surface 22 of the turbine casing 21 and because of the presence of the adjacent seal 57 on the second baffle 47, again has nowhere else to flow except through the flow apertures 54 provided through the second baffle 47. The cooling air flow is thus recirculated again as indicated generally by arrow 68 and directed through the flow apertures provided through the second baffle 47 so as to be directed as a series of cooling jets which impinge on a third area 69 of the outer surface 23, the third area being defined between the seal of the second baffle 47 and the seal of the third baffle 48.

As will be appreciated, the aforementioned recirculation and redirection of the cooling air for subsequent impingement on the outer surface 23 is again repeated in further cascaded stages through the third and fourth baffles 48, 49 in a substantially identical manner so as to be directed against respective fourth and fifth areas 70, 71 of the outer surface 23 of the turbine casing 21 for impingement cooling of those areas. After impingement cooling of the fifth area 71 which effectively represents the final downstream area of the outer surface 23 subjected to impingement cooling, the cooling air is permitted to escape from the space 41 between the manifold and the turbine casing 21.

As will be appreciated, in the particular arrangement illustrated in FIG. 5, all of the cooling air is delivered via the flow outlet apertures 63 to the first, upstream, region 58 of the space between the manifold and the turbine casing, and this air then subsequently cascades through each successive baffle for subsequent impingement cooling of the discreet downstream areas of the outer surface 23. As will be appreciated, however, as the cooling air impinges against successive areas of the outer surface 23, the air becomes gradually warmer and hence less effective for cooling surfaces. Also, it is possible that a small proportion of the cooling air will escape the system through leakage past the various seals. It is therefore envisaged that in variants of this arrangement, the cooling air may be topped up by additional cooling air from the internal chamber 30, for example by the provision of further fluid outlet apertures provided through the base 40 of the manifold 22 in communication with one or more downstream regions of the space 41.

It should be appreciated that although the particular arrangement illustrated in FIG. 5 is configured to direct cooling air in the form of impingement jets against the outer surface 23 of the turbine casing 21 in five distinct stages, the arrangement could be extended so as to have further impingement stages. Also, whilst the particular arrangement illustrated in FIG. 5 is configured such that the cascading flow of cooling air moves generally left-to-right in the orientation illustrated (i.e. in the same general direction to the flow of hot gases through the engine), the arrangement could be reversed such that the cascading flow of cooling air moves in the opposite direction (i.e. generally against the flow of hot gases through the engine). Alternatively, it is envisaged that the arrangement could be modified so that cooling air is directed the afore-mentioned cascading manner in both directions. For example, this could be achieved by replacing the primary seal 42 with a series of baffles extending to the upstream side of the fluid outlet apertures 63. In such an arrangement, each additional baffle would have the same general configuration as the baffles 46, 47, 48, and 49, but would effectively be arranged so as to form a mirror image of the baffles 46-49 in a transverse plane through the outlet apertures 63.

In summary, the impingement cooling arrangements proposed above is have been found to make significantly better use of the pressure of the engine bypass flow B for cooling purposes. In contrast, the prior art arrangements which use only one air impingement stage effectively waste the pressure available at engine cruise speeds by operating with impingement flow holes that become choked with local sonic flow speeds. In contrast, the arrangement of the present invention operates to repeatedly accelerate the flow through a series of impinging jets that are directed against the surface to be cooled in a cascading manner.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A turbine casing impingement cooling arrangement for a gas turbine engine, the arrangement comprising:

at least part of a casing configured to define a flowpath for the passage of hot gases through the engine; and a manifold spaced from said casing so as to define a space between the manifold and the outer surface of the casing, the manifold comprising a baffle extending at least partially across said space, substantially towards said casing, so as to at least partially divide said space into a first region adjacent a first area and a second region adjacent a second area, the manifold being configured to:

direct cooling air against an outer surface of the casing for impingement cooling thereof;

direct a primary flow of cooling air against said first area of the casing outer surface for impingement cooling of said first area;

recirculate at least a portion of said primary flow of cooling air after impingement against said first area; and direct at least a portion of the recirculated flow against said second area of the casing outer surface for impingement cooling of said second area.

2. A turbine casing impingement cooling arrangement according to claim 1, wherein said second area of the casing outer surface is located downstream of said first area relative to the flow direction of hot gases through the engine.

3. A turbine casing impingement cooling arrangement according to claim 1, wherein said baffle is configured so as to substantially seal against the outer surface of said casing, between said first and second areas.

4. A turbine casing impingement cooling arrangement according to claim 3, wherein said baffle comprises a substantially flexible seal configured to bear against the outer surface of said casing in a substantially sealing manner whilst permitting relative movement between the manifold and the casing.

5. A turbine casing impingement cooling arrangement according to claim 4, wherein said flexible seal is arranged so as to make an acute angle that opens in the direction of the hot gas flow with the outer surface the casing.

6. A turbine casing impingement cooling arrangement according to claim 1, wherein said manifold comprises a plenum chamber having at least one air inlet in fluid communication with said first region of the space between the manifold and the casing to admit said recirculated flow into the plenum chamber, and at least one fluid outlet in fluid communication with said second area and configured to direct said recirculated flow of cooling air from the plenum chamber against said second area in a jet.

7. A turbine casing impingement cooling arrangement according to claim 6, wherein said plenum chamber has a plurality of said fluid outlets arranged to direct said recirculated flow of cooling air from the plenum chamber against said second area in a plurality of jets.

8. A turbine casing impingement cooling arrangement according to claim 1, further comprising at least one flow aperture provided through the baffle so as to fluidly interconnect the first and second regions of said space and being configured to direct said recirculated flow of cooling air against said second area in a jet.

9. A turbine casing impingement cooling arrangement according to claim 8, comprising a plurality of said flow apertures arranged to direct said recirculated flow of cooling air against said second area in a plurality of jets.

10. A turbine casing impingement cooling arrangement according to claim 1, wherein said manifold comprises a plurality of fluid outlets arranged to direct said primary flow of cooling air against said first area in a plurality of respective jets.

11. A gas turbine engine comprising:

a turbine casing impingement cooling arrangement, including:

at least part of a casing configured to define a flowpath for the passage of hot gases through the engine; and a manifold spaced from said casing so as to define a space between the manifold and the outer surface of the casing, the manifold comprising a baffle extending at least partially across said space, substantially towards said casing, so as to at least partially divide said space into a first region adjacent a first area and a second region adjacent a second area, the manifold being configured to:

direct cooling air against an outer surface of the casing for impingement cooling thereof;

direct a primary flow of cooling air against said first area of the casing outer surface for impingement cooling of said first area;

recirculate at least a portion of said primary flow of cooling air after impingement against said first area; and direct at least a portion of the recirculated flow against said second area of the casing outer surface for impingement cooling of said second area.

12. A gas turbine engine according to claim 11, the engine taking the form of a ducted fan engine having a bypass duct defining a passage for the flow of bypass air exiting the fan, wherein the impingement cooling arrangement is configured to draw said cooling air from the bypass air flowing along said bypass duct.

* * * * *